US010087594B2

(12) United States Patent
Krill

(10) Patent No.: US 10,087,594 B2
(45) Date of Patent: Oct. 2, 2018

(54) REMOVABLE PILE CAP

(71) Applicant: Ross Krill, Calgary (CA)

(72) Inventor: Ross Krill, Calgary (CA)

( * ) Notice: Subject to any disclaimer, the term of this patent is extended or adjusted under 35 U.S.C. 154(b) by 0 days.

(21) Appl. No.: 15/095,152

(22) Filed: Apr. 10, 2016

(65) Prior Publication Data

US 2016/0298309 A1 Oct. 13, 2016

Related U.S. Application Data

(60) Provisional application No. 62/146,172, filed on Apr. 10, 2015.

(51) Int. Cl.

| | |
|---|---|
| ***E02D 5/22*** | (2006.01) |
| ***E02D 5/52*** | (2006.01) |
| ***E02D 13/00*** | (2006.01) |

(52) U.S. Cl.

CPC ..... *E02D 5/223* (2013.01)

(58) Field of Classification Search

CPC .. E02D 5/22; E02D 5/223; E02D 5/72; E02D 2200/15

USPC ..... 405/255; 52/300, 301

See application file for complete search history.

(56) References Cited

U.S. PATENT DOCUMENTS

| | | | | | |
|---|---|---|---|---|---|
| 5,011,336 | A * | 4/1991 | Hamilton | E02D 27/48 | 405/229 |
| 5,171,107 | A * | 12/1992 | Hamilton | E02D 27/48 | 405/229 |
| 6,142,710 | A * | 11/2000 | Holland, Jr. | E02D 33/00 | 405/229 |
| 6,503,024 | B2 * | 1/2003 | Rupiper | E02D 35/00 | 405/229 |
| 7,004,683 | B1 * | 2/2006 | Rupiper | E02D 5/56 | 405/229 |
| 7,506,601 | B2 * | 3/2009 | Adams | | |
| 9,051,706 | B1 * | 6/2015 | Ludwig | E02D 5/76 | |
| 2007/0065232 | A1 * | 3/2007 | Faries | E02D 5/54 | 405/230 |
| 2008/0317556 | A1 * | 12/2008 | Price | E02D 5/22 | 405/257 |
| 2012/0087741 | A1 * | 4/2012 | Desmeules | E02D 5/285 | 405/251 |

* cited by examiner

*Primary Examiner* — Benjamin F Fiorello
*Assistant Examiner* — Stacy N Lawson
(74) *Attorney, Agent, or Firm* — Sander R. Gelsing

(57) ABSTRACT

A removable pile cap is disclosed for use with a pile that is driven into the ground. The removable pile cap comprises a top member and at least one pile member positionable between at least a first orientation and a second orientation. The top member and the at least one pile member are connected together. When the at least one pile member is in the first orientation it is mountable over the pile's upper end. When the at least one pile member is in the second orientation it maintains frictional engagement with at least part of the pile's above-ground portion. The top member may be supported by the pile's upper end and is capable of accepting one or more structural foundation elements.

3 Claims, 17 Drawing Sheets

*Fig. 1 - PRIOR ART*
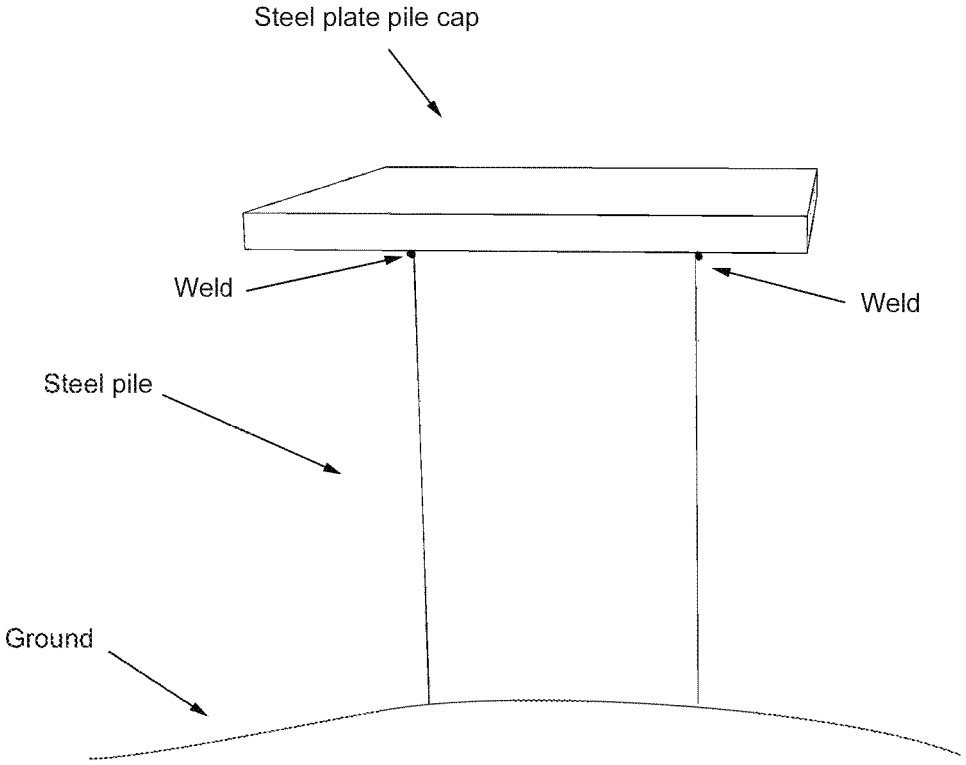

REMOVABLE PILE CAP

CROSS REFERENCE TO RELATED APPLICATION

This application is a regular application of U.S. Provisional Patent Application Ser. No. 62/146,172 filed Apr. 10, 2015 and entitled, "REMOVABLE PILE CAP", the entirety of which is incorporated herein by reference.

FIELD OF THE INVENTION

This invention relates generally to support structures or caps at the end of piles, pipes or the like. More particularly, the invention relates to a cap that is removably mountable to piles.

BACKGROUND OF THE INVENTION

The background information discussed below is presented to better illustrate the novelty and usefulness of the present invention. This background information is not admitted prior art.

Piles are commonly used to support structures such as buildings, docks, piers, pipeline tie-downs, bridges and the like where the soil is unstable, shallow, covered by water or where a geotechnical engineer might recommend a deep foundation. They are often necessary for building foundations where the ground is not compacted, or strong enough or of variable capacity to carry a building structure. Pile(s) may be driven into the ground using pile driver or drilled/screwed into the ground, much like a screw into wood, using rotary powerheads. Typically, after installation, only a small portion of the pile remains above ground.

Piles may be made of wood, concrete, steel or other suitably strong material. When made of steel they are typically manufactured using varying sizes of tubular hollow sections for the pile or anchor shaft. Piles usually have a circular cross-section (when this cross-section is on a plane that's perpendicular to the pile's longitudinal axis), but they may have other cross-sectional shapes (e.g. having a square cross-section, an octagonal cross-section or an H-shaped cross-section). The pile shaft transfers at least a portion of the structure's load into the pile and the ground.

In order to properly connect the pile(s) to the relevant structural foundation elements of the building, dock, bridge or other structure that is to be supported, adjacent steel tubular piles are typically driven into the ground so that their above-ground portions are at the desired heights. Alternatively, a pile cutter may be employed to cut a plurality of piles to the desired vertical elevation above ground. Pile caps are often employed to finish off the piles and put them into a condition to accept the structural foundation elements and the structural load.

Often these pile caps simply comprise a flat plate of steel that is welded onto the end of the pile, with the welding performed on the underside of the cap; see, for example, FIG. 1. However, there are significant costs involved in hiring a welder. It also often takes considerable time to weld each cap onto a pile. Moreover, if the top of the pile only extends above the ground a short distance, the welder will have limited space to work and/or may have to dig out some of the surrounding dirt to obtain sufficient clearance. Additionally, if the pile is made of wood or concrete, welding a pile cap onto such a pile is impossible and another fastening method will need to be employed for such piles.

As such, this conventional method of capping piles is both time consuming and expensive. Therefore, what is needed is a pile cap that is easier and quicker to install than conventional caps and which can be installed on piles made of a range of different materials.

SUMMARY OF THE INVENTION

In one aspect the invention provides a removable pile cap for use with a pile that is driven into the ground. The removable pile cap comprises a top member and at least one pile member positionable between at least a first orientation and a second orientation. The top member and the at least one pile member are connected together. When the at least one pile member is in the first orientation it is mountable over the pile's upper end. When the at least one pile member is in the second orientation it maintains frictional engagement with at least part of the pile's above-ground portion. The top member may be supported by the pile's upper end and is capable to accept one or more structural foundation elements.

In another aspect the invention provides a removable pile cap, for use with a pile that is driven into the ground, comprising a substantially planar top member, at least one substantially planar pile member having a passage of such dimensions and shape accept the pile's upper end therethrough and positionable between at least a first orientation and a second orientation, at least one pivoting hinge, and at least one tensile member. The top member and the at least one pile member are connected together serially via the at least one pivoting hinge and the at least one tensile member.

BRIEF DESCRIPTION OF THE DRAWINGS

Referring to the drawings, several aspects of the present invention are illustrated by way of example, and not by way of limitation, in detail in the figures, wherein:

FIG. 1 is a perspective view of a PRIOR ART pile cap welded onto a steel pile;

DEFINITION SECTION

Figure 2A:
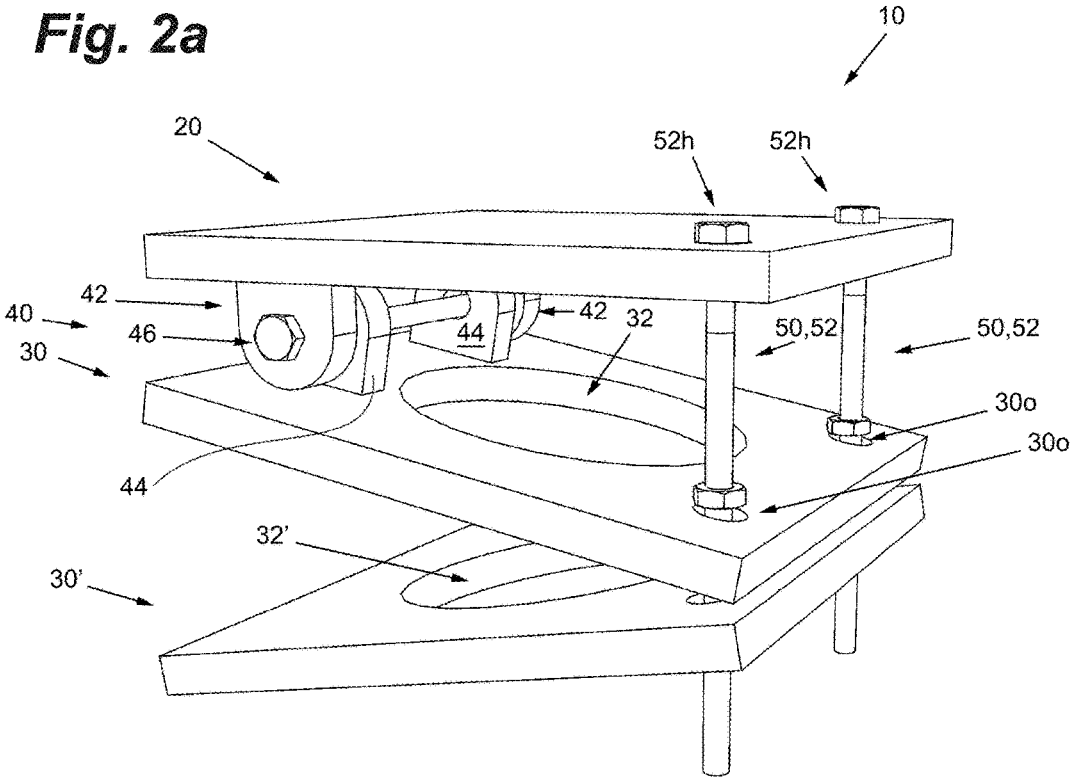
FIGS. 2*a*-2*e* are various perspective views of one embodiment of a removable pile cap.
Figure 2B:
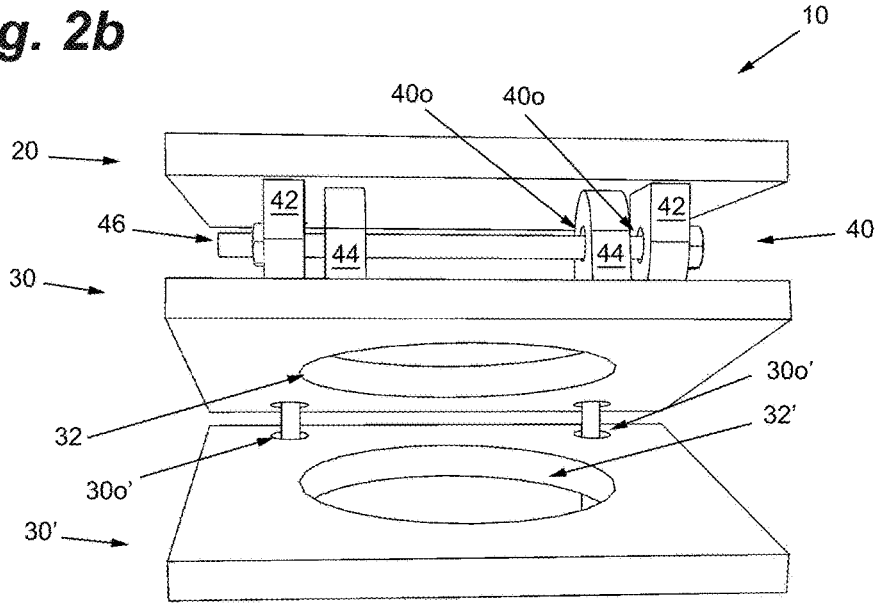
Figure 2C:
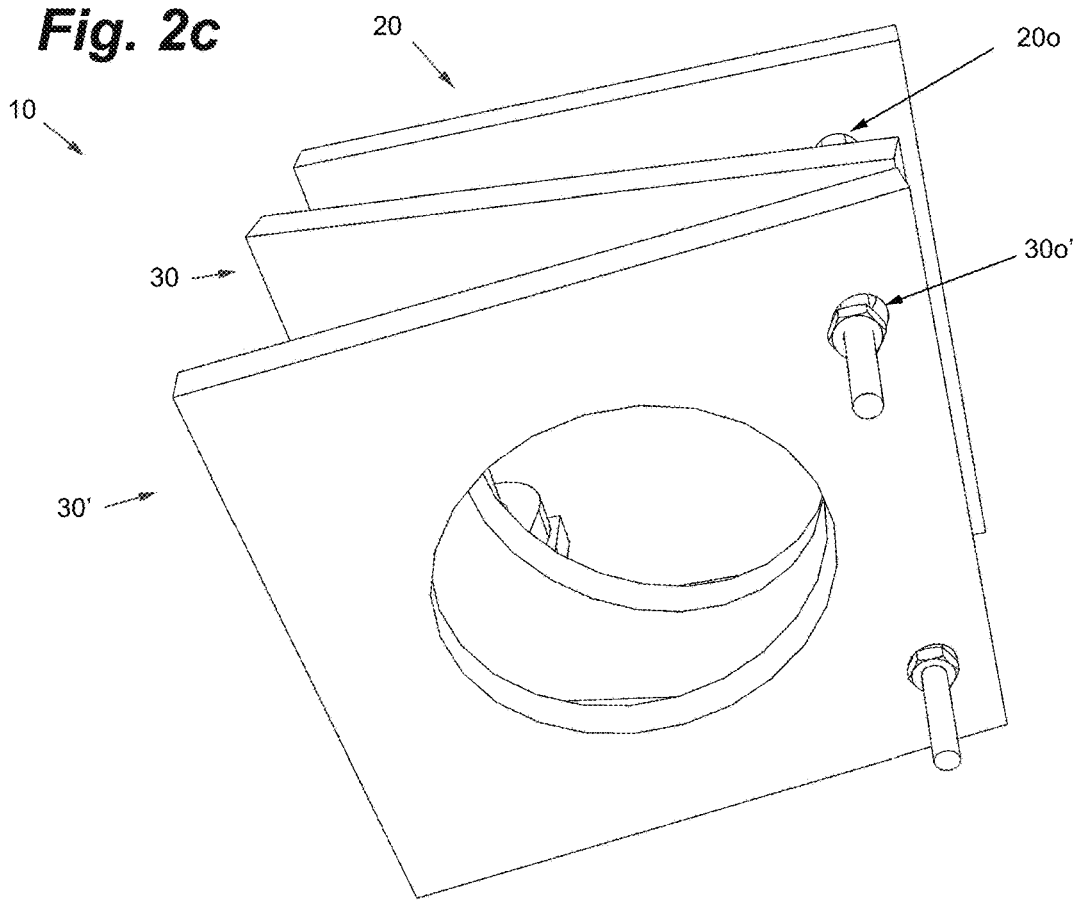
Figure 2D:
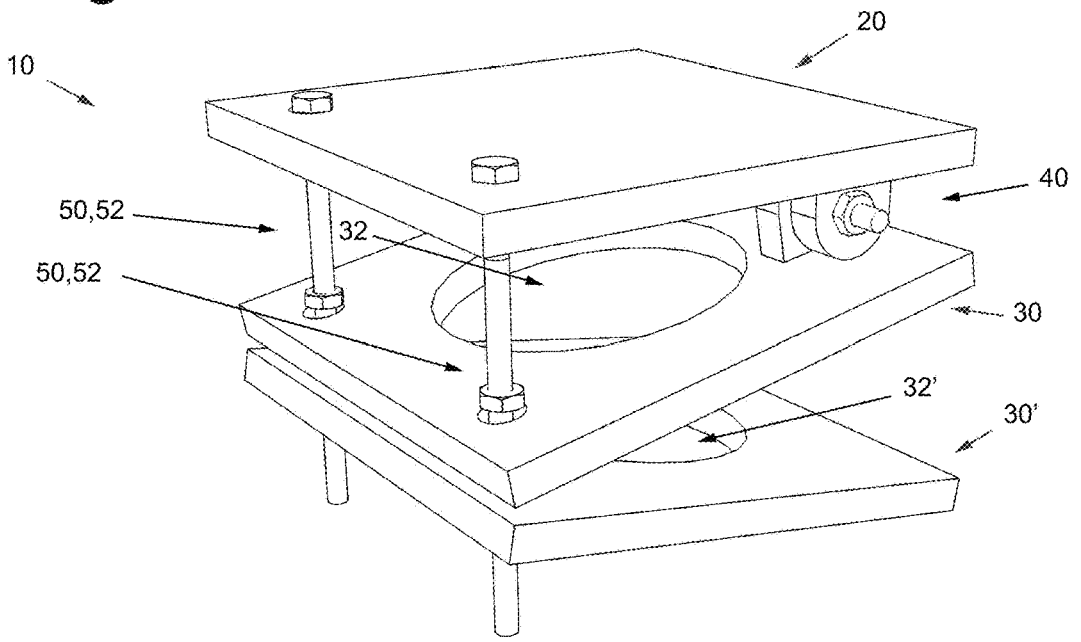
Figure 2E:
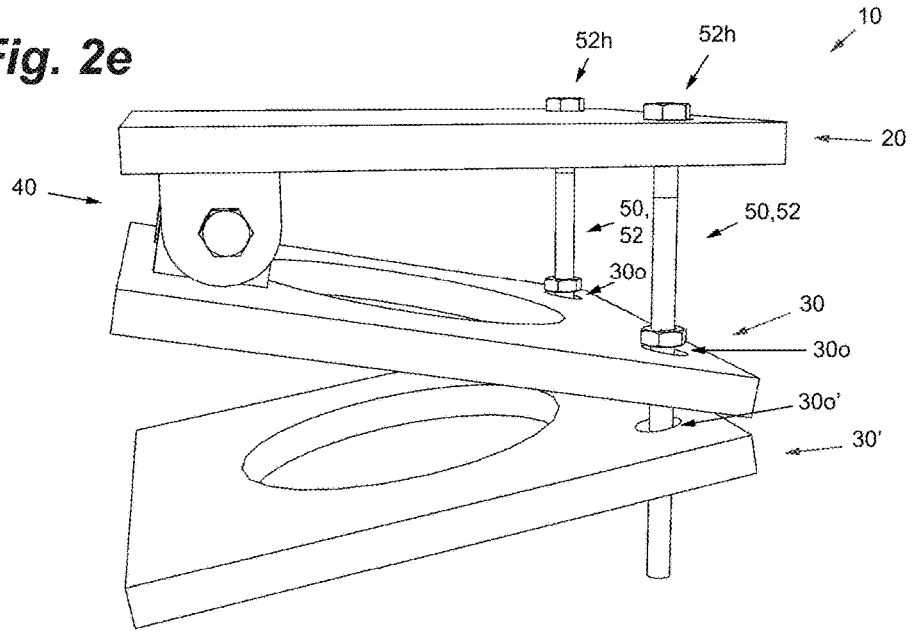

Horizontal plane, as used herein, refers to a plane that is horizontal at a given point if it is perpendicular to the gradient of the gravity field at that point, in other words, apparent gravity is what makes a plumb bob hang perpendicular to the plane at that point. In other words a horizontal plane in the plane that is perpendicular to the line that passes through the center of the Earth.

Vertical plane, as used herein, refers in astronomy, geography, geometry, and related sciences and contexts, to a direction passing by a given point if it is locally aligned with the gradient of the Earth's gravity field, i.e., with the direction of the gravitational force (per unit mass, i.e. gravitational acceleration vector) at that point.

DETAILED DESCRIPTION OF THE PREFERRED EMBODIMENTS

The following description is of preferred embodiments by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

A first embodiment of the removable pile cap 10 of the present invention is shown in FIGS. 2*a*-3*d* and is designed to be installed on a pile 1. The pile 1 has a longitudinal axis 11, an outside surface 1*s* and an outside diameter 10 (e.g. see FIG. 2*f*). The pile 1 is installed or driven substantially into the ground G with a portion of the pile 1 projecting above or out of the ground G; this portion of the pile 1 can then be referred to as the above-ground portion 1*a*, and the end of the pile 1 that projects above the ground can be referred to as the upper end 1*u*. Preferably, the pile is a generally cylindrical or tubular member with a substantially circular cross-section (when said cross-section is taken along the plane that is perpendicular to the longitudinal axis 11).

Figure 2F:
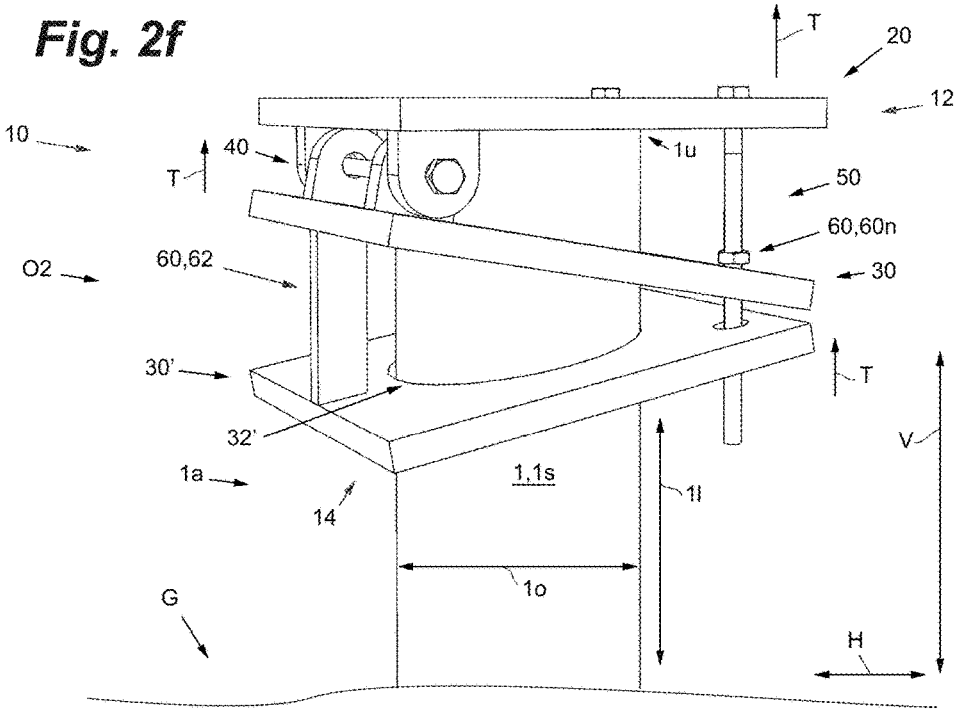
FIG. 2*f* is a perspective view of the embodiment of the removable pile cap of FIG. 2*a*, shown mounted on a pile.

More preferably the pile 1 is driven into the ground G in substantially vertical manner, with its longitudinal axis 11 substantially along, or parallel to, the vertical plane V; see FIG. 2*f*. However, the pile 1 may also have other shapes (e.g. having a square cross-section, an octagonal cross-section or an H-shaped cross-section) or be driven into the ground G with its longitudinal angle 11 at an angle offset from the vertical plane V. The pile 1 may be made of any suitable material of sufficient strength and durability to support a structure and load thereupon; for example, the pile 1 may be made of steel, wood or concrete.

Figure 9:
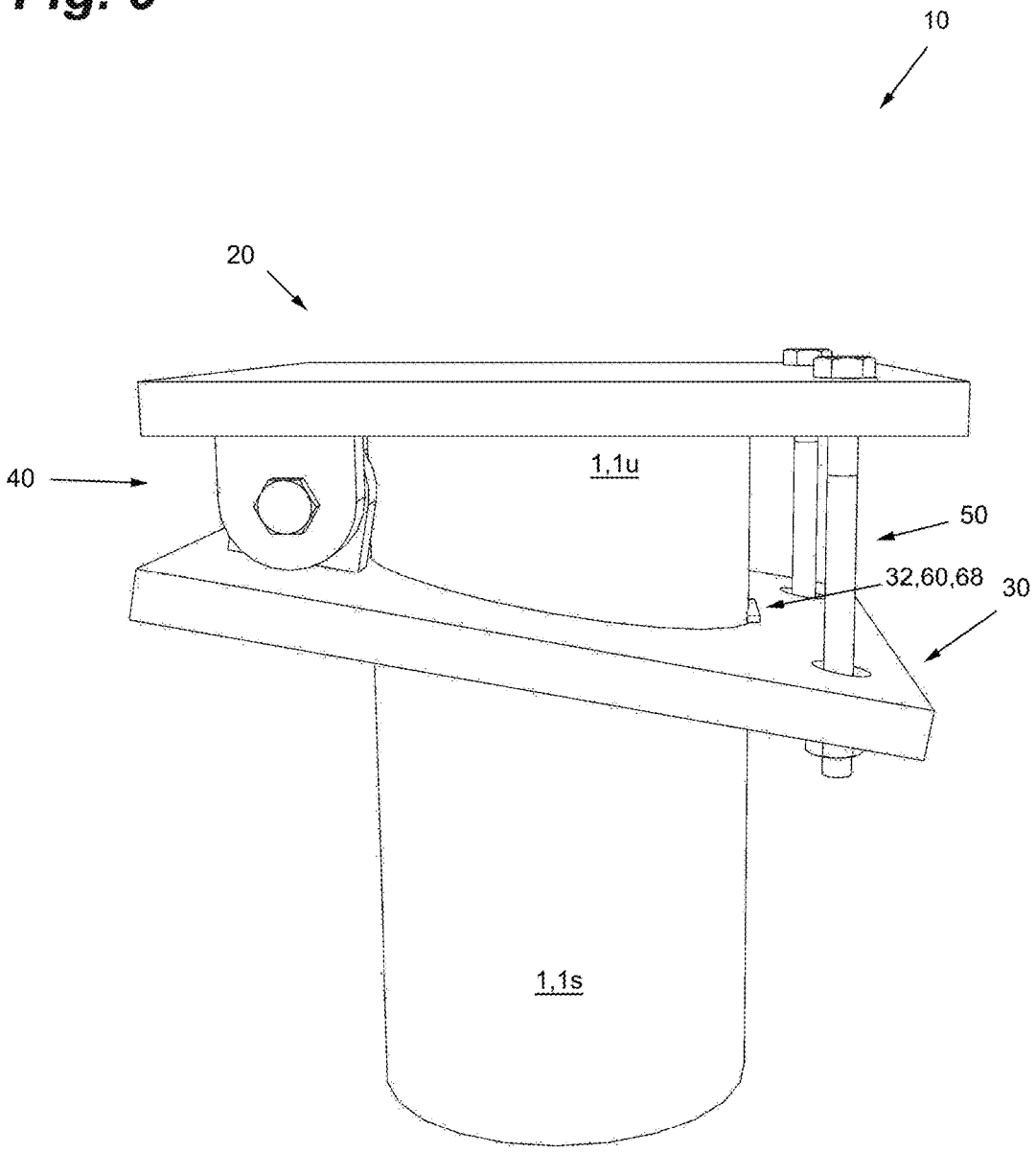
FIG. 9 is a perspective view of still yet another embodiment of a removeable pile cap, shown mounted on a pile and having only a single pile member.

The removable pile cap 10 comprises an end member 20 and at least one pile member 30 (see, for example, the embodiment of FIG. 9). The end member 20 is suitable to abut against, be placed on, and/or be supported by the pile's upper end 1*u*, in a similar manner that the flat plate of steel of traditional pile caps is laid on top of a pile's upper end (e.g. see FIGS. 2*f*-6*b*). When end member 20 is placed on the pile's upper end 1*u*, it can then also be referred to as a top member 20. The terms "end member" and "top member" will be used interchangeably herein.

The top member 20, once supported by the pile's upper end 1*u*, is suitable to accept one or more structural foundation elements, so that the load, or downward force (i.e. substantially down along the vertical plane) of any such structural foundational elements (and any structure placed thereupon) is then substantially transmitted via top member 20 into the pile 1. The top member 20 preferably comprises a substantially planar steel plate or other planar member of suitably strong material. In one embodiment of the removable pile cap 10, suitable for a cylindrical pile 1 with an outside diameter 10 of four inches (4"), the top member 20 is preferably a steel plate having width and a length of 200 mm with a thickness of 12.7 mm.

In the embodiment of FIGS. 2*a*-3*d* the removable pile cap 10 has two pile members, namely a first pile member 30 and a second pile member 30'. In another embodiment (e.g. FIG. 9), the removable pile cap 10 has one pile member. In yet another embodiment (e.g. FIG. 10), the removable pile cap 10 has three pile members, namely a first, a second and a third pile member 30, 30', 30". Generally speaking, the greater the number of pile members 30 in a particular embodiment of a pile cap 10, the greater the amount of any upward forces (i.e. substantially upward along the vertical plane V and along a pile's longitudinal axis 11) that may be successfully handled by such embodiment of the pile cap 10 during operation; assuming that all the other components and materials of the pile cap 10 are likewise suitable to handle such forces.

Figure 3A:
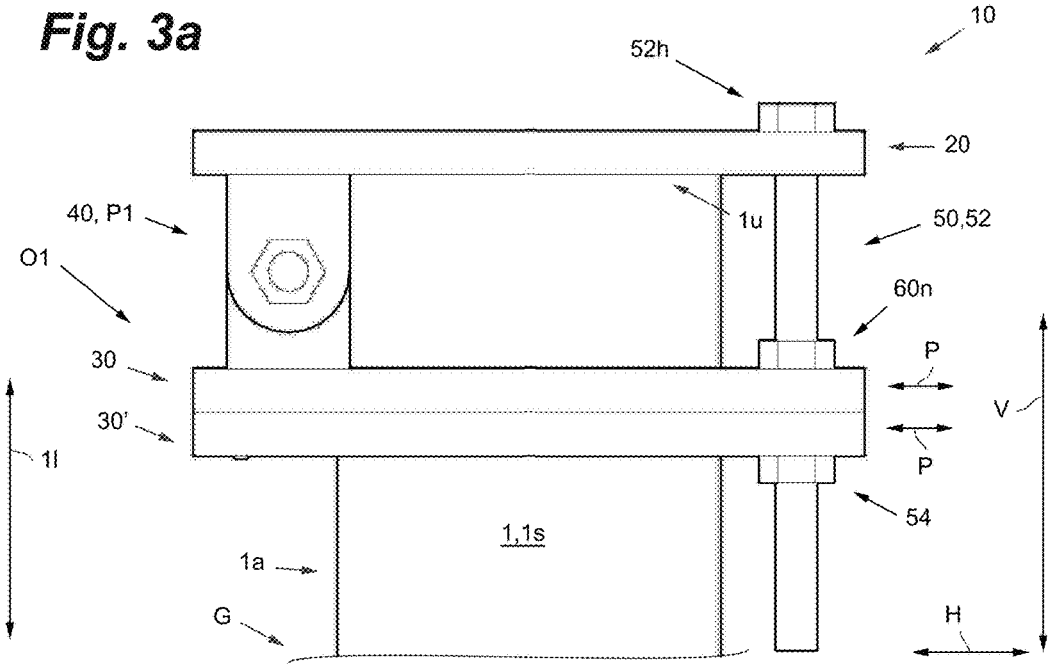
FIGS. 3*a*-3*d* are side views of the embodiment of the removable pile cap of FIG. 2*a*, showing the steps or sequence to removably mounted the pile cap on a pile and showing the pile members in a first orientation (FIG. 3*a*) and in a second orientation (FIGS. 3*b*-3*d*)
Figure 7A:
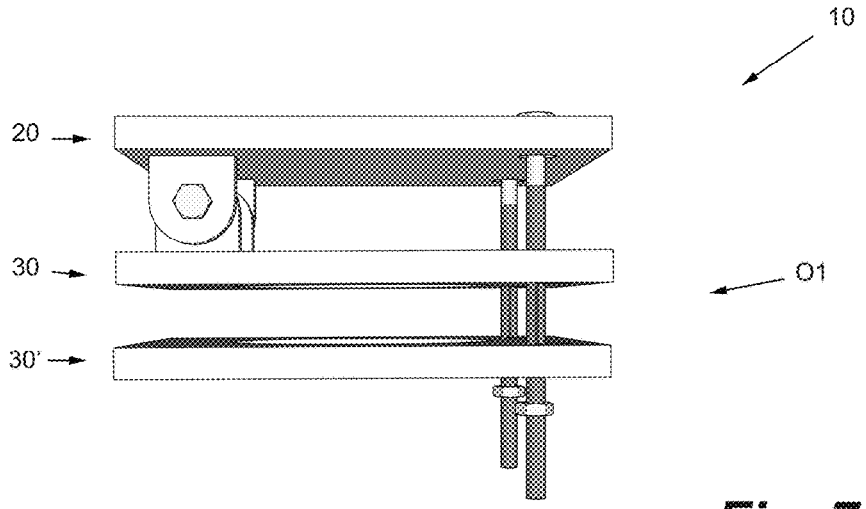
FIGS. 7*a*-7*c* are side perspective, bottom perspective and diagrammatic views of the embodiment of the removable pile cap of FIG. 2*a*, illustrating planar alignment of the pile members and their openings into a first orientation capable of being moved over part of the pile's above ground portion.
Figure 7B:
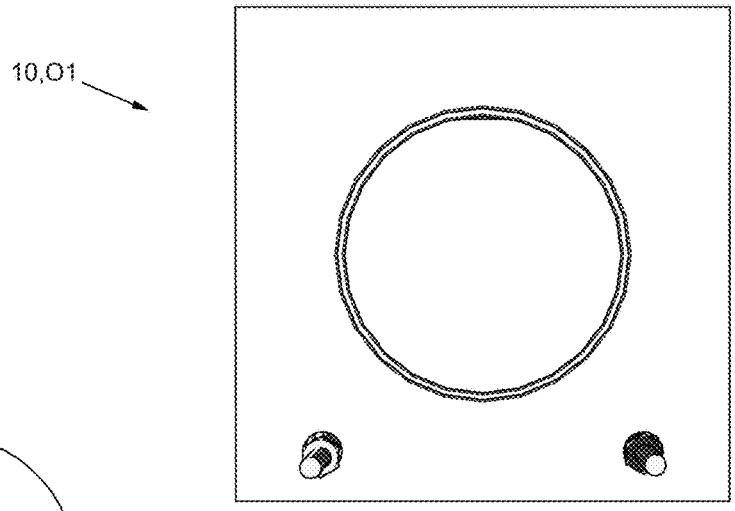
Figure 7C:
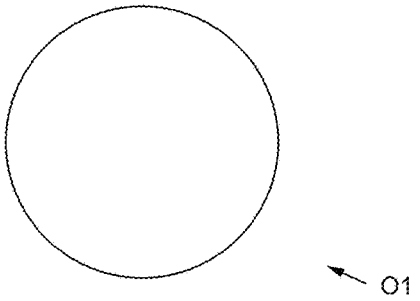
Figure 8A:
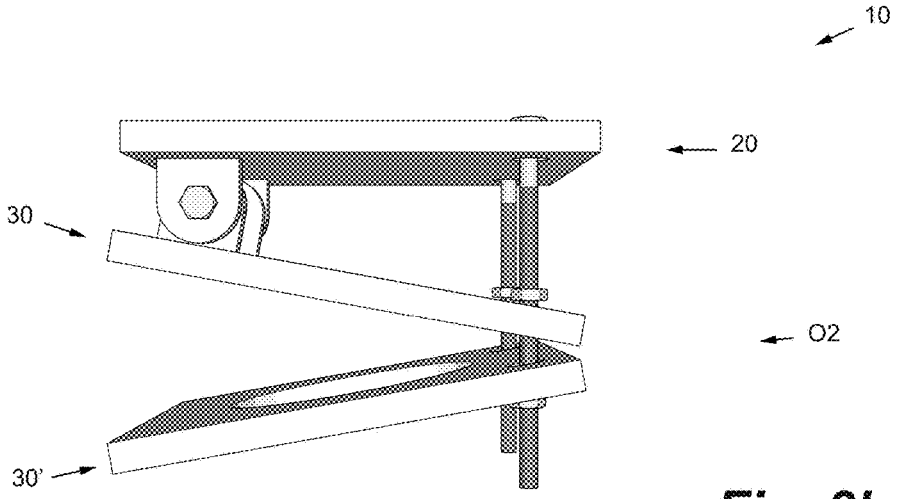
FIGS. 8*a*-8*c* are side perspective, bottom perspective and diagrammatic views of the embodiment of the removable pile cap of FIG. 2*a*, illustrating offset alignment of the pile members into a second orientation capable of binding against, and maintaining frictional engagement with, part of the pile's above ground portion.
Figure 8B:
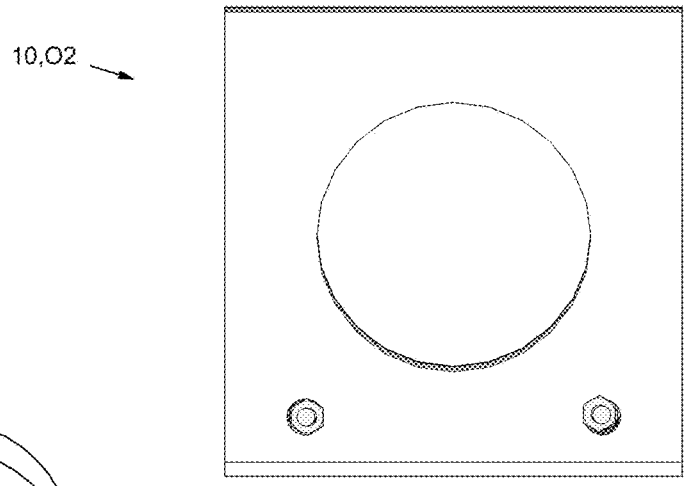
Figure 8C:
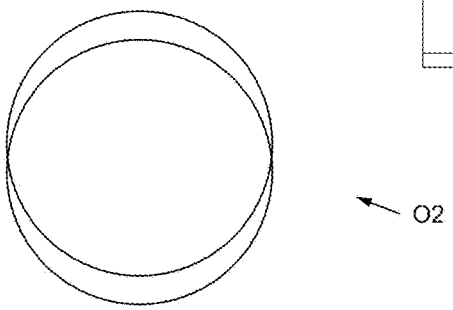

The at least one pile member 30 is suitable to be placed around or fitted over the pile's upper end 1*u* and at least part of the pile's above ground portion 1*a*, when said member 30 is substantially maintained in a first orientation O1 relative to the pile 1; e.g. see FIGS. 3*a* and 7*a*. The at least one pile member 30 is also suitable to bind against, and maintain frictional engagement with, at least part of the pile's above ground portion 1*a*, when said member 30 is substantially maintained in a second orientation O2 relative to the pile 1; e.g. see FIGS. 3*b* and 8*a*. In the embodiment of FIGS. 2*a*-3*d* the pile members 30, 30' preferably comprises a substantially planar steel plate, or other planar member along a plane P, of suitably strong material and each further comprise an opening 32,32' passage or recess therein. Opening 32,32' is of such dimensions and shape such that it is suitable to accept the pile's upper end 1*u* and then be moved or slid over at least part of the pile's above ground portion 1*a* when the pile member 30, 30' is maintained in a first orientation O1.

In one embodiment of the removable pile cap 10, suitable for a pile 1 with a substantially circular cross-section having an outside diameter 10 of four inches (4"), the pile member 30 is a steel planar plate having width and a length of 200 mm, a thickness of 13 mm and a substantially centrally located and circular opening 32,32' therethrough with a diameter of 110 mm (or approximately 4.33 inches). As such, in said embodiment and assuming the pile 1 is driven into the ground G in substantially vertical manner, with its longitudinal axis 11 substantially along, or parallel to, the vertical plane V, the pile member 30,30' will be in the first orientation O1 when its plane P is maintained substantially parallel to the horizontal plane H (e.g. see FIG. 3*a*) and will be in the second orientation O2 when its plane P is offset from the horizontal plane H (e.g. see FIG. 3*b*). A suitable amount of offset from the horizontal plane H, to place the pile member 30,30' of such embodiment in the second orientation is 15 degrees.

It will now also be understood that, when the pile 1 may be driven into the ground G with its longitudinal axis 11 off-set from the vertical plane V, the pile member 30,30' will be in the first orientation O1 when its plane P is maintained substantially perpendicular to the pile's longitudinal axis 11; and the pile member 30,30' will be in the second orientation O2 when its plane P is offset from being perpendicular to the pile longitudinal axis 11.

In another embodiment (not shown), suitable for a pile 1 with a substantially square cross-section, each sides of the square cross-section being four inches (4") in length, the pile member 30 is preferably a steel planar plate having width and a length of 200 mm, a thickness of 13 mm and a substantially centrally located and a square opening 32 therethrough with each side of that square opening being 110 mm (or approximately 4.33 inches) in length.

The top member 20 and the one or more pile members 30, 30' are connected or fastened together serially, with the top member 20 at a first end 12 of the removable pile cap 10, with one of the at least one pile members 30, 30' at a second generally opposing end 14 of the pile cap 10 and with any remaining pile members being serially connected therebetween (e.g. see FIG. 2*f*). During operation, the top member 20 and the one or more pile members 30, 30' are also connected or fastened together in a generally tensile manner, i.e. so that at least some tensile or pulling force T that may be applied to a member at one end (e.g. top member 20 at first end 12) is transmitted through the removeable pile cap 10 to the member at the opposing end (e.g. pile member 30' at second end 14; e.g. see FIG. 2*f*). Preferably, the top member 20 and the one or more pile members 30, 30' are connected or fastened together serially in such a manner that any tensile or pulling force T will bias or move the one or more pile members 30, 30' into the second orientation O2 (e.g. see FIG. 2*f*).

In the embodiment of FIGS. 2*a*-3*d* the top member 20 and pile members 30 are connected or fastened together via pivoting hinge 40 and tensile members 50. Pivoting hinge 40 pivotally connects top member 20 to a first pile member 30, allowing tensile forces to be transmitted between said members 20, 30. The pivoting hinge 40 create a pivot point P1 where the first pile member 30 rotates between position O1 into position O2 (see FIGS. 3*a*-3*b*). The pivoting hinge 40 also allows tensile forces to be transmitted between said members 20, 30.

Figure 3B:
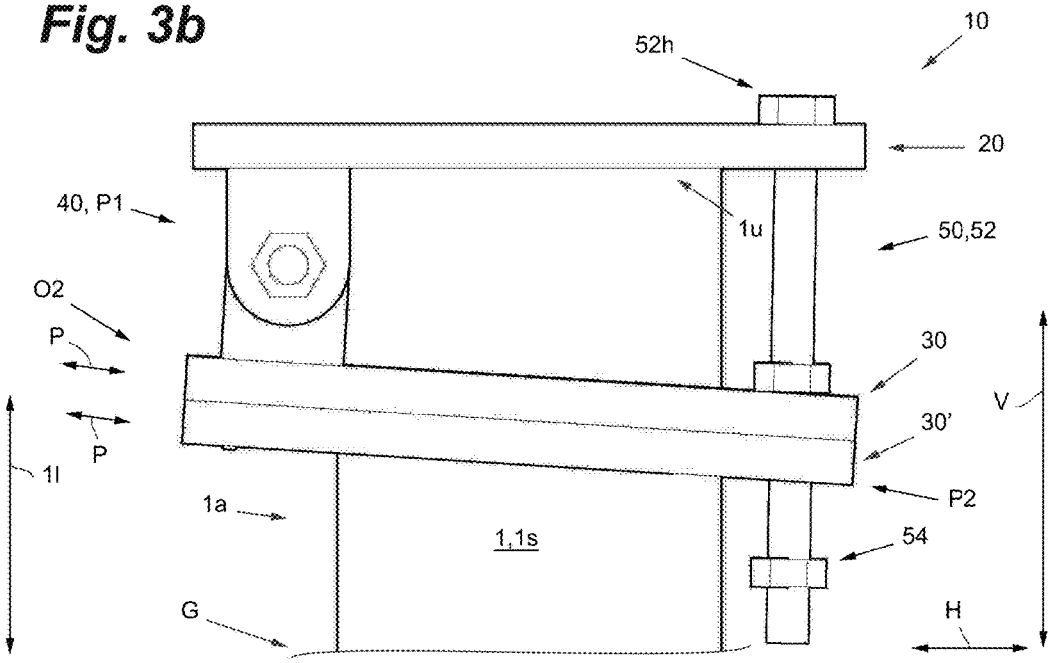
Figure 3C:
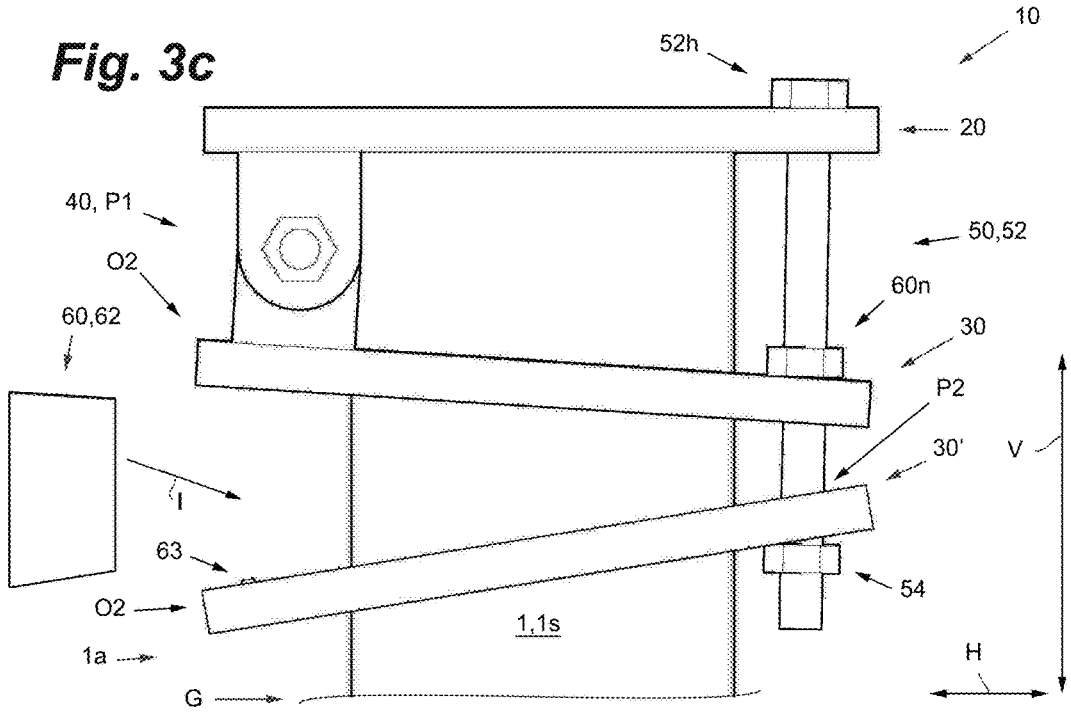

With the top member 20 being supported by the pile upper end 1*u*, the first pile member 30 may be moved from position O1 into position O2, via the pivot 40 (see FIGS. 3*a*-3*b*). When this is done, and member 30 is in position O2, the interior edge B or surface of opening 32 will frictionally engage with the pile's outside surface 1*s* and lock the pile cap 10 onto the upper end 1*u*. Similarly, any additional pile members (e.g. 30' and 30") will likewise have an interior edge B or surface of their openings (e.g. 32') frictionally engage with the pile's outside surface 1*s* when in position O2.

In this embodiment, pivoting hinge 40 comprises a first set of two legs 42 depending from the top member 20 towards the first pile member 30, and a second set of two legs 44 depending from the first pile member 30 towards the top member 20. Each of the leg members have a substantially circular hole or opening 40*o* therethrough, suitable to accept a bolt or hinge pin 46 therethrough, when the openings 40*o* of first and second sets of legs 42, 44 are aligned; see FIGS. 2*a*-2*f*.

Further in the embodiment of FIGS. 2*a*-3*d* the top member 20 and pile members 30' are connected or fastened together via tensile members 50 which comprise a pair of bolts 52 placed through a pair of bolt openings 20*o* in the top member 20 and through a corresponding pair of bolt openings 30*o*' in pile member 30'. Said bolt openings 20*o*, 30*o*' in each of top member 20 and pile member 30' are of sufficient size to accept the shank 52*s* of the bolt therethrough, but prevent passage of the bolt's head 52*h* or any nut 54 therethrough. Bolts 52 may also pass or slide through pile member 30, by way of a pair of bolt opening 30*o* therein, sufficiently dimensioned to accept the shank 52*s* of the bolt therethrough, but also sufficiently dimensioned prevent passage of the bolt's head 52*h* or any nut 54 therethrough. Nuts 54 are utilized in a conventional manner to secure bolts 52 and allowing tensile forces T to be transmitted between said the top member 20 at first end 12 and the pile member 30' at second end 14. The tensile members 50 (with their shanks 52) positioned though opening 30' in pile member 30' create a second pivot point P2 where the second pile member 30' rotates between position O1 into position O2 (see FIGS. 3*b*-3*c*).

To unlock and remove the pile cap 10 from the pile 1, all pile members (30, 30', 30") can be moved to position O1, thereby becoming free to slide along pile 1.

Preferably, the removable pile cap 10 further comprises securing or lock means 60 that can be used to maintain the one or more pile members 30, 30' into the second orientation O2. In the embodiment of FIGS. 2*a*-3*d* securing means 60 comprises one or more nuts 60*n* on bolts 52 that can be threaded along shank 52*s* and, along with hinge 40, maintain pile member 30 in the second orientation (e.g. see FIGS. 2*f*, 3*d*). In the embodiment of FIGS. 2*a*-3*d* securing means 60 further comprises a steel wedge member 62 that can be positioned between pile member 30 and pile member 30', thereby maintaining pile member 30' in the second orientation (e.g. see FIGS. 2*f*, 3*d*). Preferably, securing means 60 further comprises elevation or bump 63 on pile member 30' to assist with maintaining wedge member 62 positioned between pile member 30 and pile member 30' (e.g. see FIGS. 3*c* and 3*d*). Alternatively, wedge member 62 may be secured in place via a quick tack weld.

Advantageously, when the one or more pile members 30, 30' are in the second orientation O2, and the top member 20 and the one or more pile members 30, 30' are fastened together serially, the removable pile cap 10 is secured onto the pile 1 without the need for welding and can be used on piles made of a variety of materials (e.g. steel, concrete or wood). As such, the second orientation O2 can also be referred to as the secured or locked orientation of the pile cap 10, in that the pile cap 10 will then be secured onto the pile 1. In particular, any load forces (typically downward) will simply be transmitted into the pile 1 via top member 20. Any forces that opposes the load (i.e. typically upward) will, assuming they overcome such a load, simply result in maintaining the pile members 30, 30' in the second orientation O2 (and further engaging any interior edge B of opening 32 with the pile's surface 1*s*, thereby even further securing the pile cap 10 to the pile 1). Any forces that may be lateral to the pile's longitudinal axis 11 (i.e. typically sideways forces) will be countered by the pile members 30, 30' being placed around the pile 1.

More advantageously, by adapting the dimensions of the opening 32 in a pile member 30 to correspond to the outside dimensions of a pile 1 (e.g. circular opening 32 for a pile with a circular cross-section; or square opening 32 for a pile with a square cross-section), the removable pile cap 10 can be used and installed on a variety of pile shapes. Even more advantageously, and as will now be appreciated by those skilled in the art, it will take only a small amount of time and effort to place a pile cap 10 over a pile 1 (e.g. FIG. 3*a*), move the pile members 30, 30' into the second orientation O2 (e.g. FIGS. 3*b*-3*c*) and engage the lock means 60 (e.g. FIG. 3*d*). The inventor estimates that a pile cap 10 can be positioned and secured on a pile 1 within 15 minutes for an experienced installer; thereby saving the costs normally associated with welding a cap onto a pile. Still more advantageously, the pile cap 10 of the present invention can be installed even when there is limited space to work and without having to dig out some of the surrounding dirt to obtain sufficient clearance for a welder to work.

Other Embodiments

In FIGS. 4*a*-4*e* another embodiment of the invention 10 is shown. This embodiment is similar to the embodiment of FIGS. 2*a*-3*d*, but instead of the top member 20 and pile members 30' being connected together via tensile a pair of bolts 52 a second pivoting hinge 40' pivotally connects first pile member 30 to second pile member 30' (with top member 20 similarly being connected to first pile member 30 vial first pivoting hinge 40), allowing tensile forces to be transmitted between said members 20, 30, 30'.

Figure 5A:
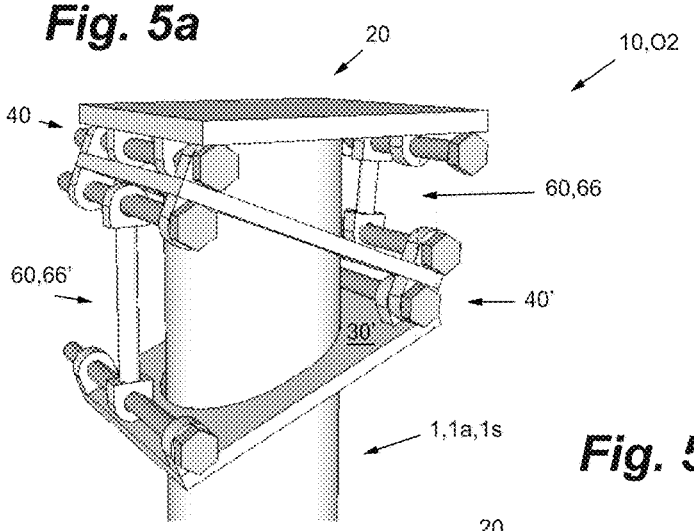
FIGS. 5*a*-5*c* are various perspective views of yet another embodiment of a removeable pile cap, shown mounted on a pile.
Figure 5B:
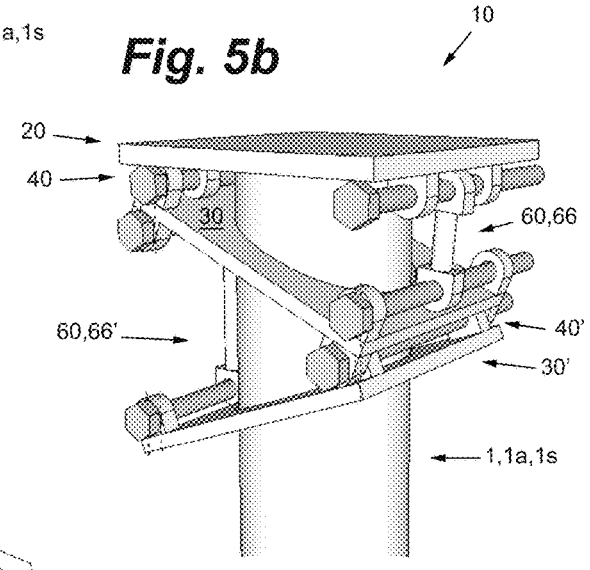
Figure 5C:
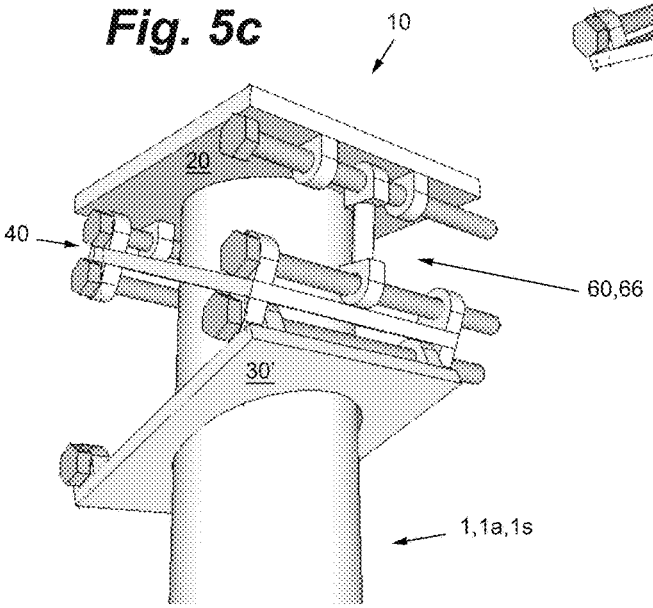
Figure 6A:
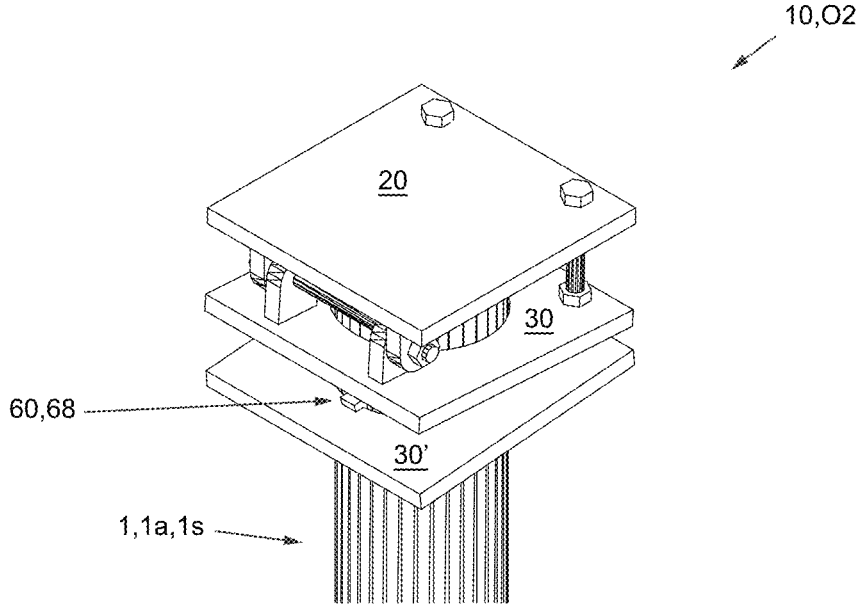
FIGS. 6*a*-6*b* are various perspective views of still yet another embodiment of a removeable pile cap, shown mounted on a pile.
Figure 6B:
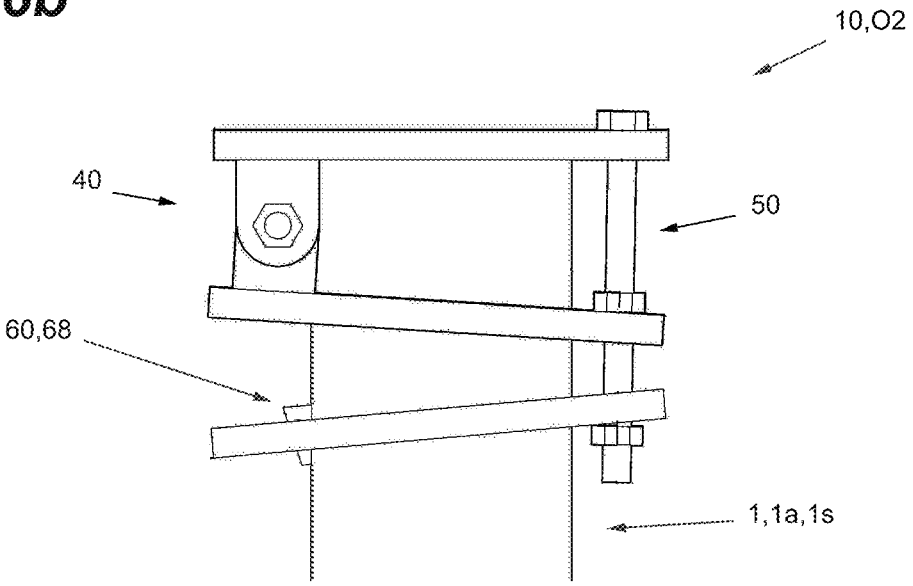

In FIGS. 5*a*-5*c* yet another embodiment of the invention 10 is shown. This embodiment is similar to the embodiment of FIGS. 4*a*-4*e*, but the securing means 60 comprises rod members 66, 66' that may be removably secured between top member 20 and first pile member 30, and between first pile member 30 and second pile member 30'; as more clearly shown in FIGS. 5*a*-5*c*.

In FIGS. 6*a*-6*e* yet another embodiment of the invention 10 is shown. This embodiment is similar to the embodiment of FIGS. 2*a*-3*d*, but instead of securing means 60 comprising a wedge member that can be positioned between pile member 30 and pile member 30' (to maintain pile member 30' in the second orientation O2), securing means 60 instead comprises wedge member 68 that is insertable in opening 32' so as to wedge between pile member 30' and the pile 1 and thereby maintain pile member 30' in the second orientation O2. In yet another embodiment (e.g. FIG. 10), where the pile cap 10 is expected to remain installed on the pile 1 for the long term, the securing means is a quick tack weld W that is applied between pile member 30 and pile 1 at approximately the same location where wedge member 68 is placed in the embodiment of FIGS. 6*a*-6*e*.

In FIG. 9 another embodiment of the invention 10 is shown. This embodiment is similar to the embodiment of FIGS. 2*a*-3*d*, but instead of comprising two pile members, the pile cap 10 comprises a single pile member 30. Further, as in the embodiment of FIG. 6*a*-6*e*, securing means 60 comprises wedge member 68 that is insertable in opening 32 so as to wedge between pile member 30 and the pile 1 and thereby maintain pile member 30 in the second orientation O2.

Figure 10:
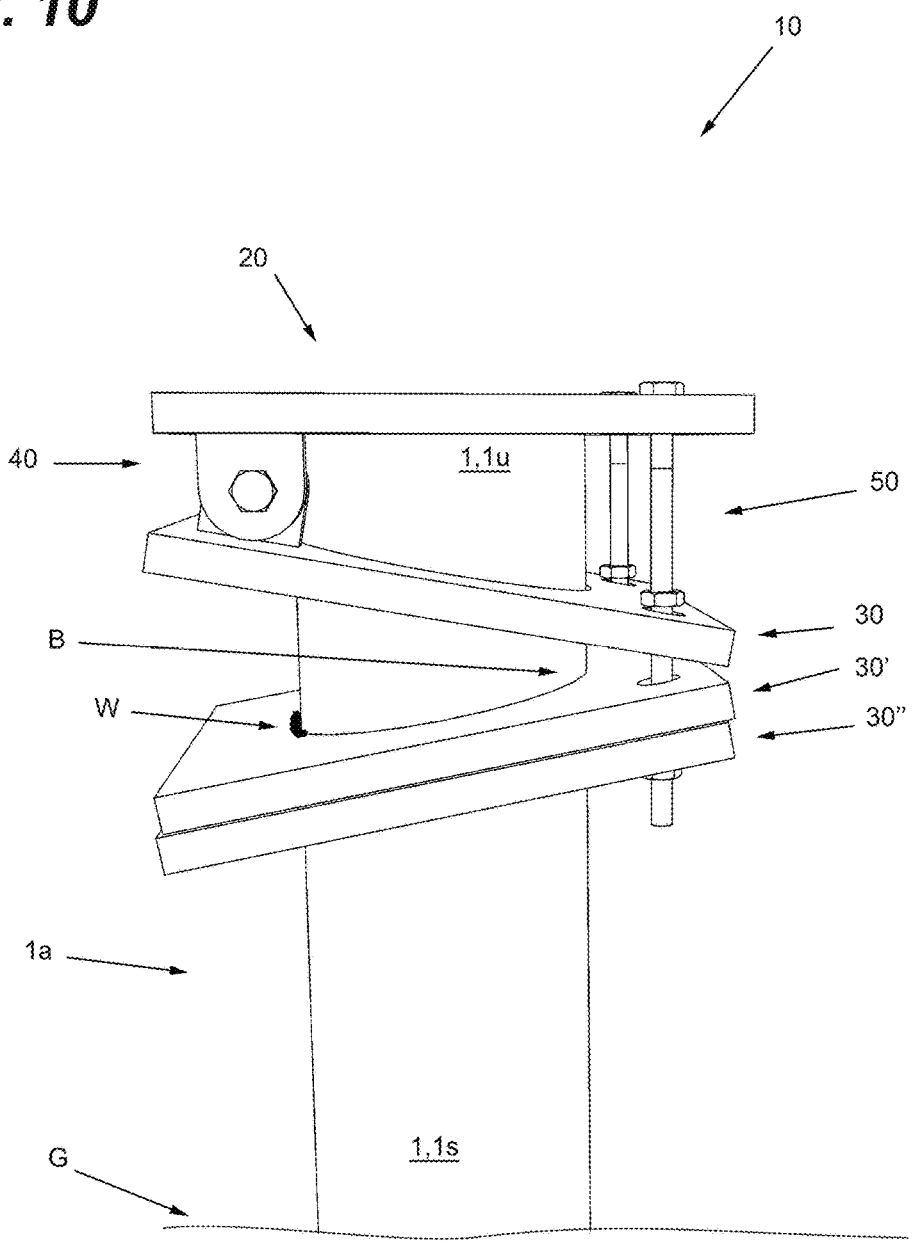
FIG. 10 is a perspective view of still yet another embodiment of a removeable pile cap, shown mounted on a pile and having three pile members.

In FIG. 10 yet another embodiment of the invention 10 is shown. This embodiment is similar to the embodiment of FIGS. 2*a*-3*d*, but instead of comprising two pile members, the pile cap 10 comprises a three pile members 30, 30' and 30". Advantageously, the plurality of pile members 30, 30' and 30", once placed in the second orientations O2, provide additional biting edges B to allow said pile members 30, 30' and 30" to bind against, and maintain frictional engagement with, at least part of the pile's above ground portion 1*a*. More advantageously, such additional pile members 30, 30' and 30" and biting edges B provide for increased resistance to any upward forces that may act on the pile cap 10 (and any structural foundation elements thereon), such as in cases where buildings may be exposed to high wind loads. In this embodiment, the securing means 60 is a quick weld W that is applied between pile member 30 and pile 1 at approximately the same location where wedge member 68 is placed in the embodiment of FIGS. 6*a*-6*e*.

Figure 11:
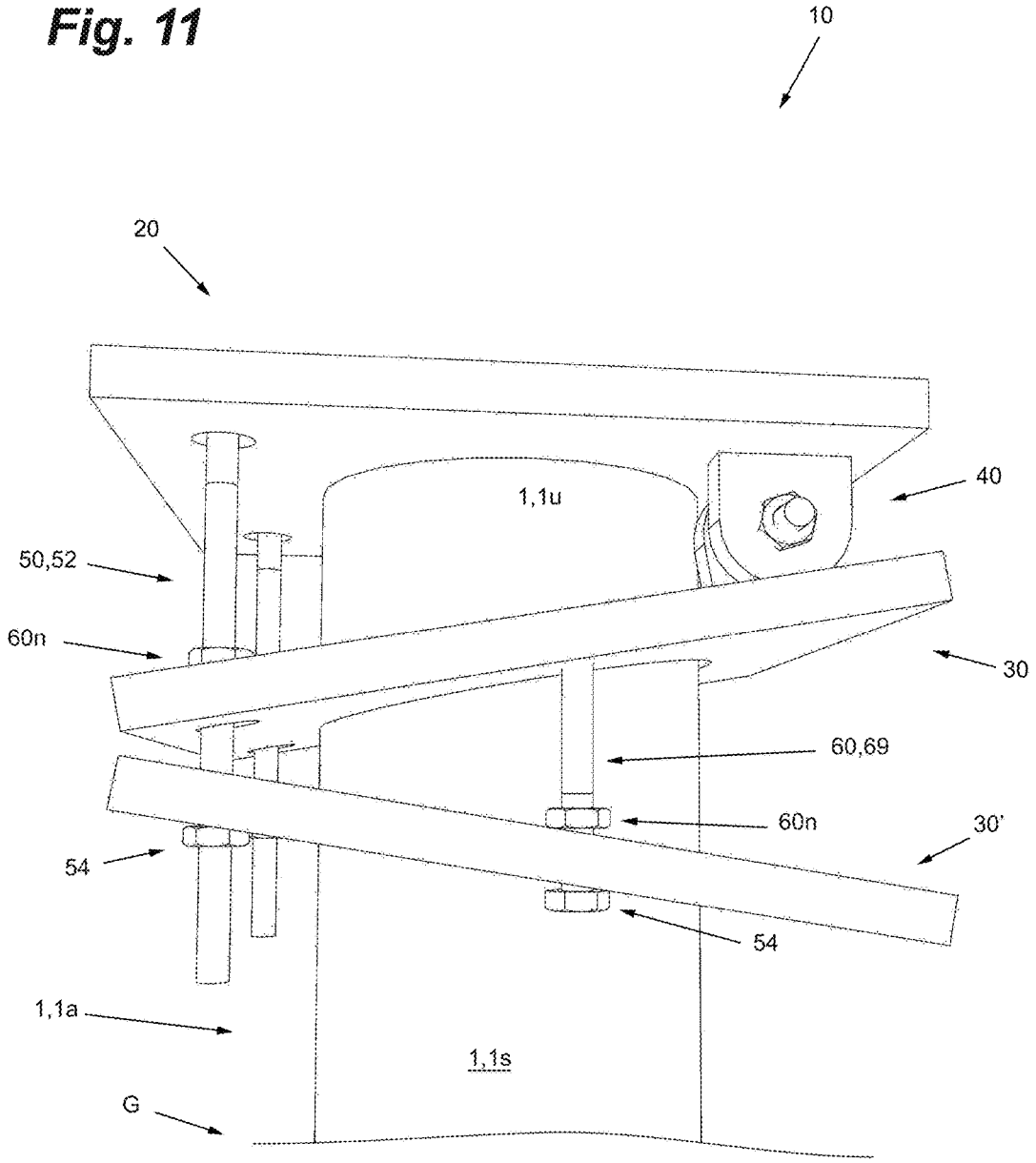
FIG. 11 is a perspective view of still yet another embodiment of a removeable pile cap, shown mounted on a pile.
Figure 12A:
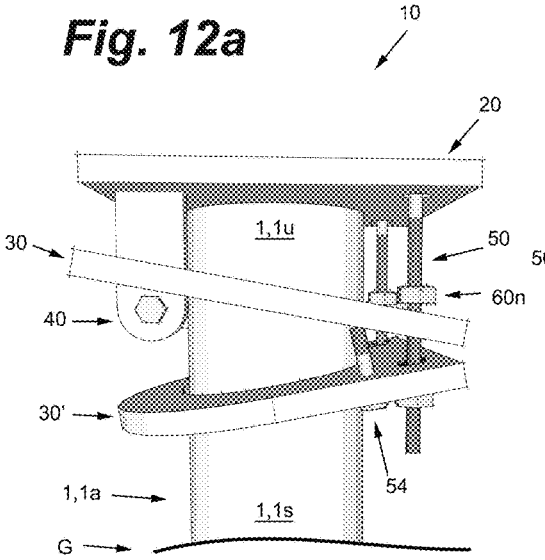
FIGS. 12*a* to 12*f* are various perspective views of still yet another embodiment of a removeable pile cap, shown mounted on a pile.
Figure 12B:
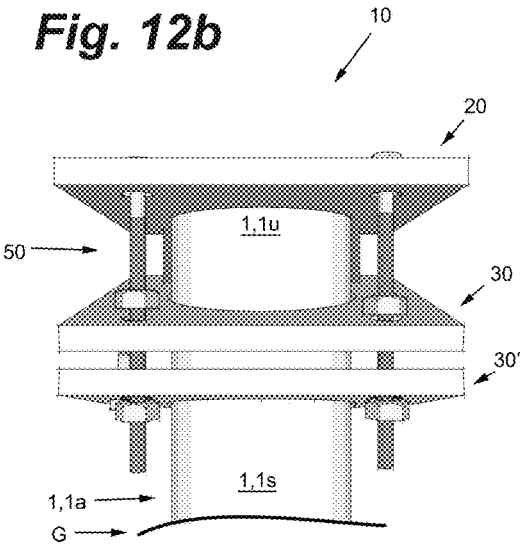
Figure 12C:
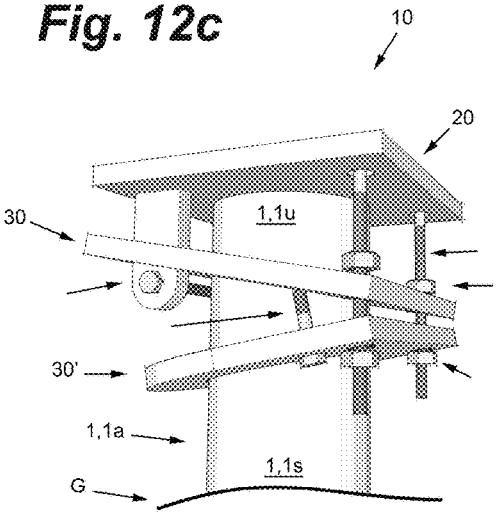
Figure 12D:
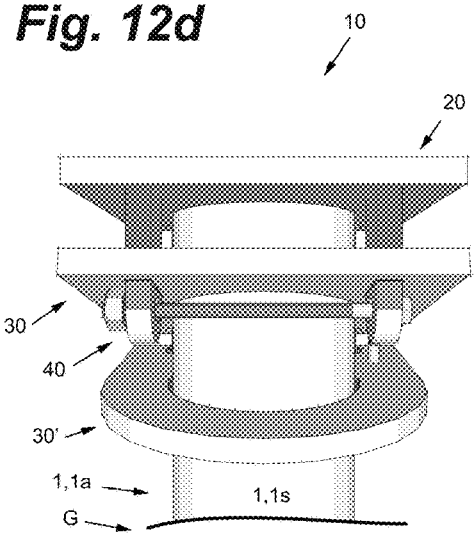
Figure 12E:
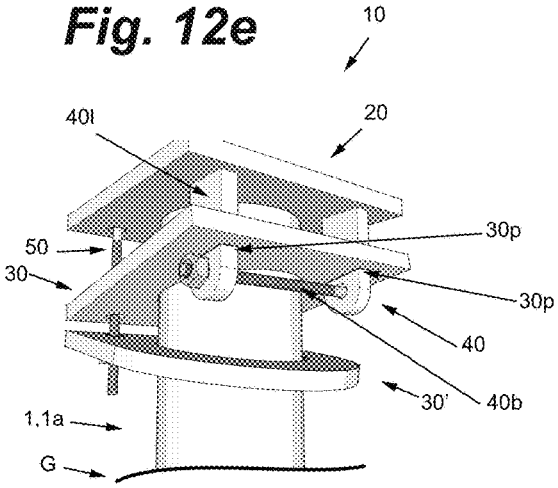
Figure 12F:
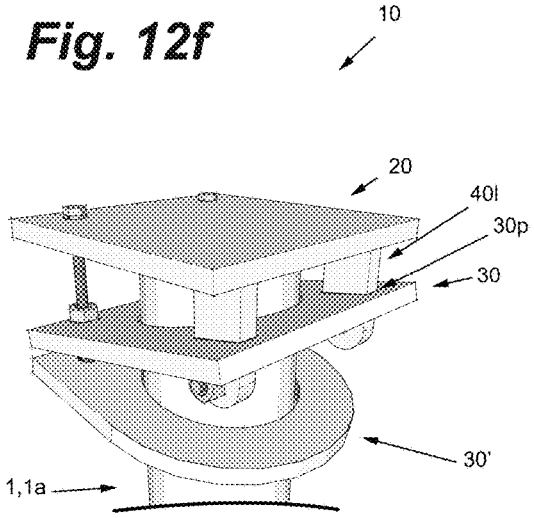

In FIG. 11 yet another embodiment of the invention 10 is shown. This embodiment is similar to the embodiment of FIGS. 2*a*-3*d*, but instead of securing means 60 comprising a wedge member that can be positioned between pile member 30 and pile member 30' (to maintain pile member 30' in the second orientation O2), securing means 60 instead comprises one or more nuts 60*n* on bolts 52 that can be threaded along shank 52*s*, one or more nuts 60*n* on set screw 69 (with set screw 69 depending from member 30 and passing through an opening (not shown) in member 30') and hinge 40, to maintain pile member 30 in the second orientation.

In FIGS. 12*a*-12*f* yet another embodiment of the invention 10 is shown. This embodiment is similar to the embodiment of FIG. 11, but in this embodiment the pivoting hinge 40 comprises two hinge members or legs 401 which project from top member 20 towards and through pile member 30, via corresponding leg passages 30*p* provided on pile member 30. Leg passages 30*p* are of sufficient size to accept hinge legs 401 therethrough and to allow pile member 30 to pivot therealong between the first and second orientations. Once passed through leg passages 30*p*, the distal ends of the hinge legs 401 are preferably connected via a bolt and nut assembly 40*b*. Leg passages 30*p* are of such size and dimensions to prevent passage of the bolt and nut assembly 40*b* therethrough, effectively capturing pile member 30 on hinge legs 40*l* once bolt and nut assembly 40*b* is mounted to the distal ends of the hinge legs 40*l*—see FIGS. 12*e* and 12F.

Example

Figure 3D:
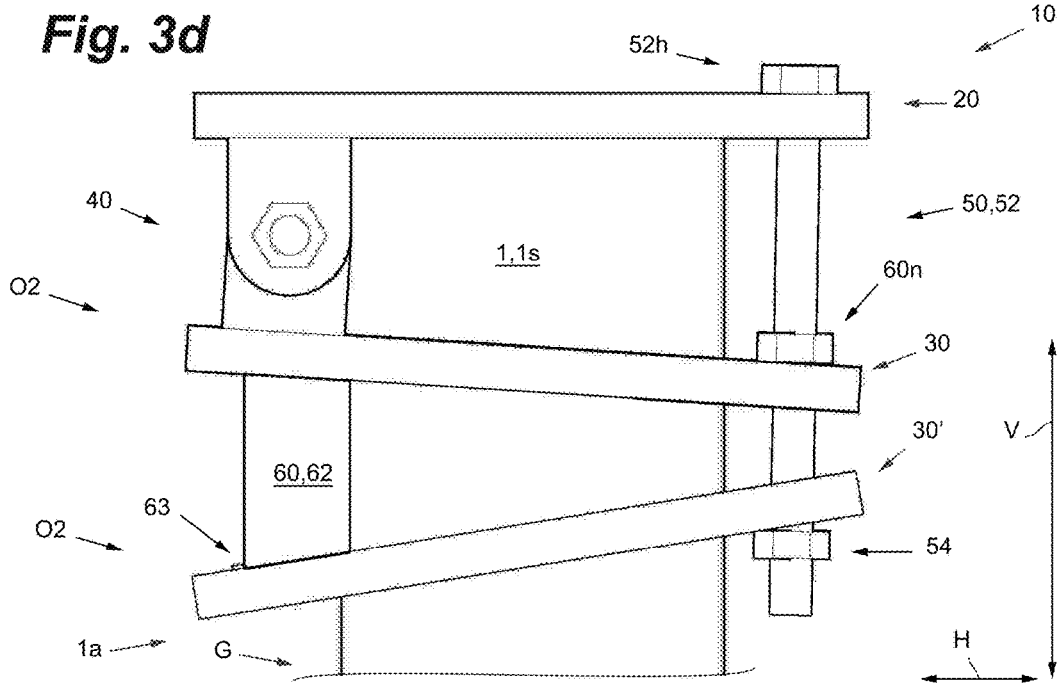
Figure 4A:
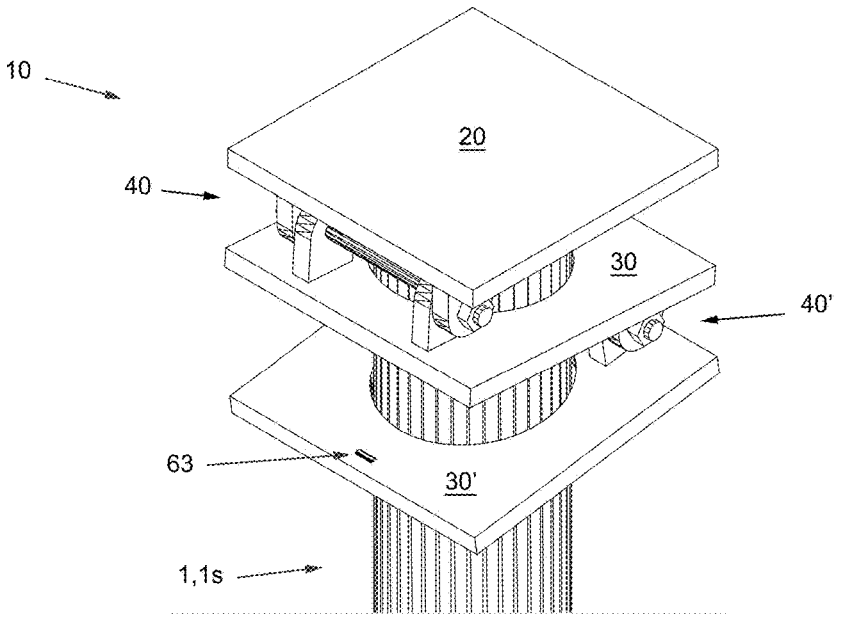
FIGS. 4*a*-4*e* are various perspective views of another embodiment of a removeable pile cap, shown mounted on a pile and shown using another embodiment of a lock member to maintain the pile members in the second orientation (FIGS. 4*d*-4*e*)
Figure 4B:
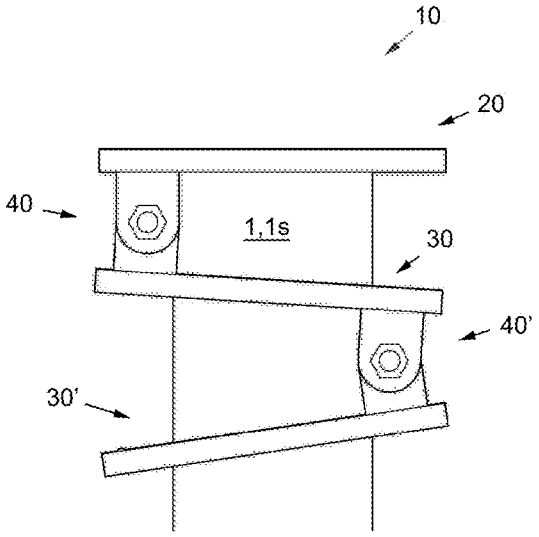
Figure 4C:
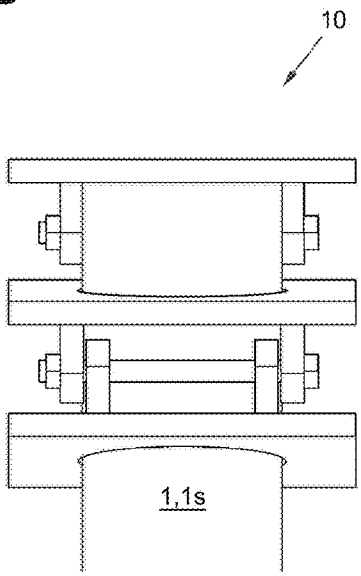
Figure 4D:
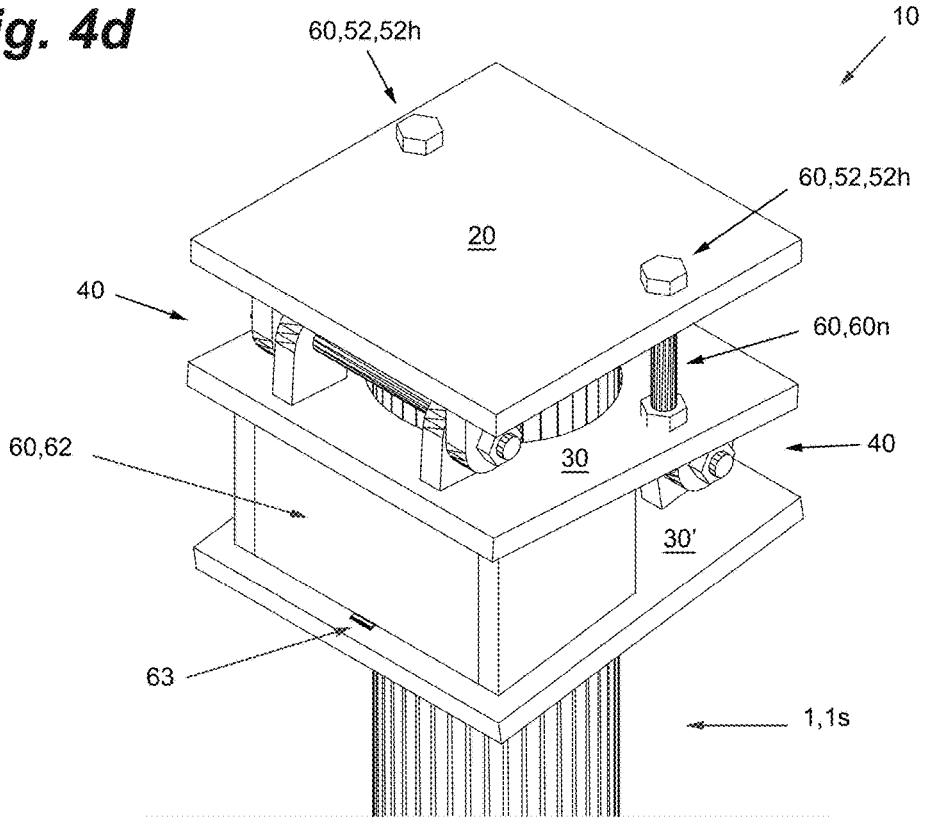
Figure 4E:
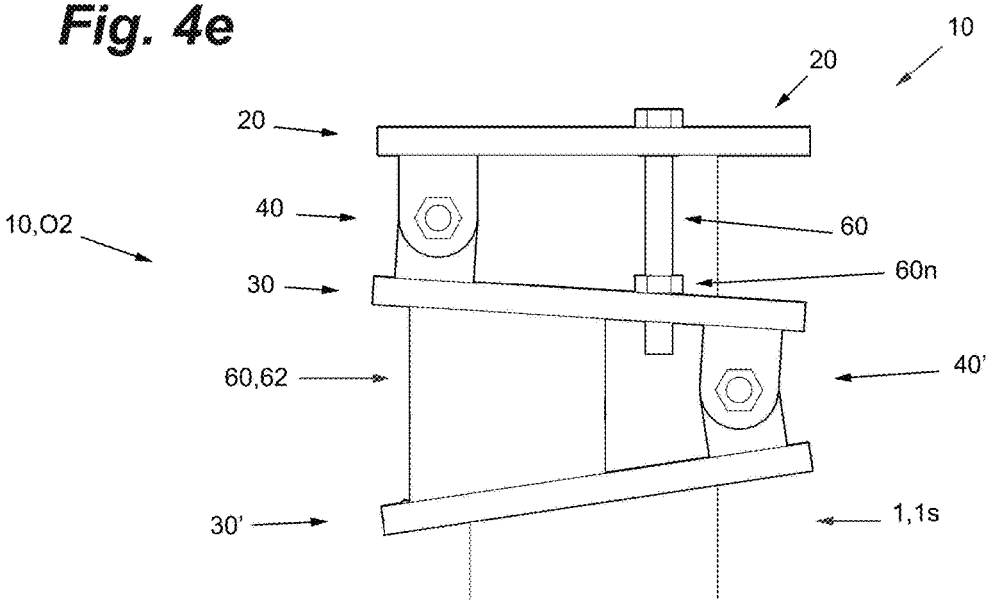

In one embodiment of the removable pile cap 10, similar to the embodiment of FIGS. 2*a*-3*d*, the pile cap 10 was secured on a cylindrical pile 1 with an outside diameter 10 of four inches (4"), in a manner similar to that shown in FIGS. 2*f* and 3*d*, with the pile members 30, 30' in the second orientation O2. In this embodiment, the top member 20 was a CAN/CSA G40.21 Grade 300 W steel plate having width and a length of 200 mm with a thickness of 12 mm, with the pile members 30, 30' and the hinge's legs 42,44 likewise being made of 12 mm thick steel, and with bolts 46 and 52 being steel ⅜" bolts. Holes 32, 32' were substantially centrally located and circular openings having a diameter of 110 mm. Once the pile cap 10 was in the secured orientation, an increasing tension force T was applied to the top of the top member 20, causing the interior surfaces and edges B of holes 32, 32' to frictionally engage the outside surface 1*s* of pile 1. At a tension force T of 26 kN, it was observed that the pile cap 10 remained substantially in the secured orientation with only 8 mm of deformation occurring, this being a combination of the pile members 30, 30' biting into the pile 1, as well as some minor bolt 46, 52 deflection. As the tension force T increased, to a tension T of 59.7 kN, bolt 46 in the hinge 40 sheared. A final 18 mm deformation of the pile cap 10 was observed just prior to bolt 46 shearing.

Those of ordinary skill in the art will appreciate that various modifications to the invention as described herein will be possible without falling outside the scope of the invention. In the claims, the word "comprising" is used in its inclusive sense and does not exclude other elements being present. The indefinite article "a" before a claim feature does not exclude more than one of the features being present.

The embodiments of the invention in which an exclusive property or privilege is being claimed are defined as follows:

1. A removable pile cap, for use with a pile that is driven into the ground, the pile having a longitudinal axis, an outside surface, an outside diameter, a cross-section taken along a plane that is perpendicular to said longitudinal axis and an above-ground portion having an upper end, the removable pile cap comprising:

a top member; and at least one pile member positionable between at least a first orientation and a second orientation;

wherein, when the at least one pile member is in the first orientation, the at least one pile member is mountable over the pile's upper end;

wherein, when the at least one pile member is in the second orientation, the at least one pile member maintains frictional engagement with at least part of the pile's above-ground portion;

wherein the top member and the at least one pile member are connected together serially;

wherein the at least one pile member further comprises a passage to accept the pile's upper end therethrough along a passage axis;

wherein the top member and the at least one pile member are connected together to form a pivot point about a pivot axis, said pivot axis formed substantially perpendicular to the passage axis;

wherein the top member and the at least one pile member are each substantially planar members; and wherein the top member and the at least one pile member are connected together via at least one pivoting hinge and at least one tensile member.

2. The removable pile cap of claim 1 wherein the pivoting hinge creates the pivot point about which the at least one pile member is capable of pivoting between the first orientation and the second orientation.

3. The removable pile cap of claim 2 further comprising securing means to maintain the at least one pile member in the second orientation.

* * * * *